US008712290B2

(12) United States Patent
Yamamoto et al.

(10) Patent No.: US 8,712,290 B2
(45) Date of Patent: Apr. 29, 2014

(54) ELECTROSTATIC CHARGER AND IMAGE FORMING APPARATUS

(75) Inventors: Masanobu Yamamoto, Osaka (JP); Takashi Tokuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 201 days.

(21) Appl. No.: 13/499,315

(22) PCT Filed: Sep. 28, 2010

(86) PCT No.: PCT/JP2010/066755

§ 371 (c)(1),
(2), (4) Date: Mar. 30, 2012

(87) PCT Pub. No.: WO2011/040380

PCT Pub. Date: Apr. 7, 2011

(65) Prior Publication Data

US 2012/0189348 A1 Jul. 26, 2012

(30) Foreign Application Priority Data

Oct. 1, 2009 (JP) ..... 2009-229919

(51) Int. Cl.
*G03G 15/02* (2006.01)

(52) U.S. Cl.
USPC ..... 399/173

(58) Field of Classification Search
USPC ..... 399/168, 170, 171, 172, 173
See application file for complete search history.

(56) References Cited

U.S. PATENT DOCUMENTS

| | | | | |
|---|---|---|---|---|
| 3,777,158 | A * | 12/1973 | Kamogawa et al. | 250/324 |
| 5,742,874 | A * | 4/1998 | Koshimura et al. | 399/100 |
| 6,944,413 | B2 * | 9/2005 | Maeda | 399/92 |
| 2008/0304866 | A1 | 12/2008 | Takenaka et al. | |

FOREIGN PATENT DOCUMENTS

| | | | |
|---|---|---|---|
| JP | 57189156 | A * | 11/1982 |
| JP | 61213868 | A * | 9/1986 |
| JP | 9-197766 | A | 7/1997 |
| JP | 9-230668 | A | 9/1997 |
| JP | 10-307441 | A | 11/1998 |
| JP | 11-143179 | A | 5/1999 |
| JP | 2006-98509 | A | 4/2006 |
| JP | 2008-257183 | A | 10/2008 |

* cited by examiner

*Primary Examiner* — Quana M Grainger
(74) *Attorney, Agent, or Firm* — Birch, Stewart, Kolasch & Birch, LLP

(57) ABSTRACT

An electrostatic charger (32A) of an image forming apparatus (1) takes the air not containing dust inside from the outside of an image forming unit (101) by an air current generator (632A), and delivers an air current through a passage (43A) to an air-intake opening (524A) formed in a bottom face (521A) of a case (52A). The air current taken inside the case (52A) from the air-intake opening (524A) is directed by a guide plate (56A) and an air barrier (57A) to a tip portion (531A) of a discharge electrode (53A), and then passing the tip portion (531A), it is exhausted via an opening (520A) of the case (52A) through an exhaust duct (62A) from an air-exhaust opening (63A) to the outside of the image forming unit (101).

4 Claims, 6 Drawing Sheets

ELECTROSTATIC CHARGER AND IMAGE FORMING APPARATUS

TECHNICAL FIELD

The present invention relates to an electrostatic charger provided with a non-contact type discharge electrode charging a photoreceptor in image forming by an electrophotography method, and to an image forming apparatus comprising the electrostatic charger.

BACKGROUND ART

Conventionally, among the image forming apparatus forming an image by the electrophotography method, there have been ones in which a photoreceptor is charged by an electrostatic charger with a non-contact type discharge electrode fixed in a shielding case having an opening. The electrostatic charger performs corona discharge (hereinafter, simply referred to as a discharge) to the photoreceptor from a tip portion of the discharge electrode to which a high voltage is applied, thereby causing the photoreceptor to be charged with electricity.

In the electrostatic charger, the ion wind occurring at the time of the discharge causes the air to flow in from the opening of the shielding case, and this in turn causes a circulation of air to occur inside the shielding case. At that time, if dust flows in from the outside of the shielding case, then the dust sticks to the discharge electrode. The dust sticking to any place other than the tip portion of the discharge electrode may not cause any problem; however, when the dust sticks to the tip portion of the discharge electrode, a discharge irregularity occurs due to the hindrance to a uniform discharge, thereby making it difficult for the photoreceptor surface to be charged uniformly.

For this reason, among the conventional electrostatic chargers each comprising a discharge electrode are ones in which the dust is prevented from sticking to the discharge electrode by diverting the ion wind to the opening of the shielding case by means of taking the air into the shielding case from a slit formed at the bottom of the shielding case (e.g., refer to Patent Literature 1).

CITATION LIST

Patent Literature

[Patent Literature 1]

Japanese Patent Unexamined Publication No. 9-230668 bulletin

SUMMARY OF INVENTION

Technical Problem

In the electrostatic charger as described in the Patent Literature 1, however, since a flow velocity is slow when the slit is provided over the entire bottom face of the case because then the whole interior of the case becomes a passage of the ion wind, it is difficult to exhaust the ion wind sufficiently from the opening to the outside of the shielding case; so that the air current that has passed the surface of the photoreceptor is prone to flow into the shielding case. Also, since the air inside the shielding case is exhausted from the opening toward the photoreceptor, dust such as silica particles and/or toner particles floating around the photoreceptor are drawn into the shielding case from the slit. As a result, the conventional electrostatic charger fails to make sure of preventing dust adhesion to the tip portion of the electrode from occurring, thereby making it difficult to sufficiently reduce image deterioration caused by the discharge irregularity.

The present invention is directed to providing an electrostatic charger that is capable of ensuring the prevention of dust adhesion to a tip portion of a discharge electrode and thereby capable of sufficiently reducing image deterioration due to the discharge irregularity, and to providing an image forming apparatus comprising the electrostatic charger.

Solution to Problem

An electrostatic charger of the present invention comprises a discharge electrode, a case for shielding, an air current generating section and a guide member, and charges a photoreceptor by performing a discharge to the photoreceptor. The discharge electrode has a saw-toothed tip portion. The case for shielding, being disposed surrounding the discharge electrode leaving a space in between, is provided with an opening at which a grid electrode is installed opposed to a plurality of the tip portions of the discharge electrode, and a bottom face in which a first air-intake opening is provided opposed to an edge portion on the opposite side of the tip portions of the discharge electrode. The air current generating section generates an air current that flows in from the first air-intake opening and passes through the interior of the case. The guide member is installed in the case, and directs the air current generated by the air current generating section from the first air-intake opening to the tip portions of the discharge electrode in the case, thereby forming a passage of the air current passing around the tip portions. The configuration enables the air current that is directed by the guide member to the tip portions of the discharge electrode to flow encompassing the tip portions of the discharge electrode, thereby keeping the tip portions always protected by the air current. Moreover, the air current always passing around the tip portions makes it unlikely for the dust to stick to the tip portions.

In another embodiment of the present invention, the electrostatic charger in the above-mentioned configuration further comprises an air-intake passage and an air-exhaust passage. The air-intake passage directs the air current from a second air-intake opening that is isolated from the photoreceptor to the first air-intake opening. The air-exhaust passage directs the air current exhausted from the case after passing the tip portions of the discharge electrode to an air-exhaust opening that is isolated from the second air-intake opening. With this configuration, because the air-intake opening is installed at a position isolated from the photoreceptor and from the air-exhaust opening, it is made possible to supply clean air not containing the dust floating around the photoreceptor to the opening of the case. Besides, because the air current having passed the tip portions of the discharge electrode is exhausted through the air-exhaust opening, it does not stay in the electrostatic charger; so that it is made possible for the air current not containing dust to always pass around the tip portions.

In still another embodiment of the present invention, the guide member in the above-mentioned configuration has a top surface inclined at an angle that is not less than an angle of elevation for the tip portions of the discharge electrode. If an air current occurs circulating through the photoreceptor and interior of the case, the circulating air current is caused to flow along the top surface of the guide member when it comes into contact with the guide member. Besides, the air current taken inside from the opening always passes around the tip portions of the discharge electrode. Thus, the circulating air current will not come into contact with the tip portions of the discharge electrode, so that adhesion of dust to the tip portions can be prevented.

In still yet another embodiment of the present invention, a passage formed by the guide member in the above-mentioned configuration is narrower than the first air-intake opening. Because the passage formed by the guide member is narrower than the first air-intake opening, the air current having flowed in from the first air-intake opening is accelerated when it passes the passage formed by the guide member. As a result, because the air current passes around the tip portions of the discharge electrode at a high velocity, the air current can protect the tip portions of the discharge electrode, thereby preventing the dust adhesion thereto more securely.

An image forming apparatus of the present invention comprises an electrostatic charger configured as described above, and an image forming section. The image forming section forms a toner image on a photoreceptor charged by the electrostatic charger, and then transfers the toner image onto paper. With the configuration, the image forming apparatus makes the tip portions of the discharge electrode free from dust adhesion thereto, and thus can prevent the occurrence of discharge irregularity, thereby making it possible to form a clear image.

Advantageous Effects of Invention

The present invention enables tip portions of a discharge electrode to be always protected by an air current directed by a guide member to pass the tip portions, and thus ensures the prevention of dust adhesion to a tip portion of a discharge electrode, thereby sufficiently reducing image deterioration due to a discharge irregularity.

DESCRIPTION OF EMBODIMENTS

An image forming apparatus comprising an electrostatic charger according to an embodiment of the present invention is explained below as an example.

Figure 1:
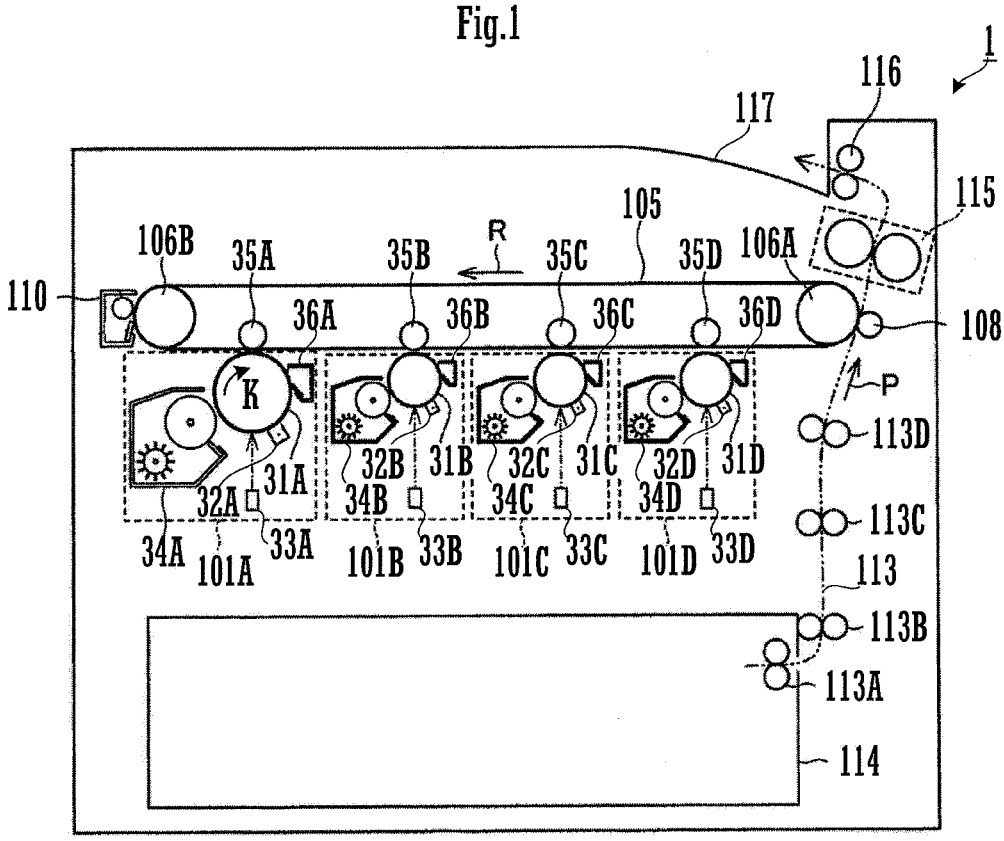
FIG. 1 is a front schematic view of an image forming apparatus comprising an electrostatic charger according to an embodiment of the present invention.

As shown in FIG. 1, the image forming apparatus 1 includes four image forming units 101A through 101D, an intermediate transfer belt 105, a secondary transfer roller 108, a belt cleaning unit 110, a paper conveying path 113, a tray 114, a fuser unit 115, a copied paper delivery roller 116, a copy receiving tray 117 and a control section not shown.

The intermediate transfer belt 105 is an endless belt, and being passed over a support roller 106A and a support roller 106B, it rotates in a direction of the arrow R. On an inner circumferential side of the intermediate transfer belt 105 are disposed primary transfer rollers 35A through 35D in this order between the support roller 106B and the support roller 106A. On a peripheral part of the intermediate transfer belt 105 are disposed the image forming units 101A through 101D, the secondary transfer roller 108, and the belt cleaning unit 110 in this order.

The secondary transfer roller 108 is disposed opposed to the support roller 106A sandwiching the intermediate transfer belt 105 in between. The belt cleaning unit 110 is disposed opposed to the support roller 106B sandwiching the intermediate transfer belt 105 in between.

The four image forming units 101A through 101D are the image forming units that form black, cyan, magenta, and yellow toner images, respectively. The image forming units 101A through 101D each have the same configuration; therefore, explanation is being made hereinafter mostly on the image forming unit 101A.

The image forming unit 101A includes an electrostatic charger 32A, an exposure device 33A, a developing device 34A, a transfer device (primary transfer roller) 35A and a cleaning device 36A; and they are disposed on a peripheral part of a photoreceptor drum 31A in this order. The photoreceptor drum 31A is disposed opposed to the primary transfer roller 35A sandwiching the intermediate transfer belt 105 in between.

Beneath the image forming units 101A through 101D is disposed a tray 114 that receives paper. Along the paper conveying path 113 are disposed a plurality of feed rollers 113A through 113D, the support roller 106A, the secondary transfer roller 108, the fuser unit 115, and the copied paper delivery roller 116 in this order.

The image forming apparatus 1 operates as follows. Each of the image forming units 101A through 101D forms an image by the directions of the control section. For example, in the image forming unit 101A, the electrostatic charger 32A charges the photoreceptor drum 31A, and then the exposure device 33A forms an electrostatic latent image on the photoreceptor drum 31A. The developing device 34A supplies a toner to the photoreceptor drum 31A, and thus renders the electrostatic latent image manifest in a toner image. The primary transfer roller 35A transfers the toner image on the photoreceptor drum 31A onto the intermediate transfer belt 105. The cleaning device 36A cleans a surface of the photoreceptor drum 31A after the transfer of the toner image.

The respective single color toner images formed by the respective image forming units 101A through 101D are transferred in a superimposed manner onto the intermediate transfer belt 105, thereby forming a color image.

Paper contained in the tray 114 is sent out by the feed roller 113A, and conveyed by the feed rollers 113B through 113D in a direction of the arrow P to a secondary transfer position where the secondary transfer roller 108 is disposed opposed to the intermediate transfer belt 105.

The color image formed on the intermediate transfer belt 105 is transferred onto paper at the secondary transfer position by the support roller 106A and the secondary transfer roller 108. The surface of the intermediate transfer belt 105 after the transfer of the color image is cleaned by the belt cleaning unit 110.

The paper onto which the color image has been transferred is conveyed to the fuser unit 115. The fuser unit 115 fixes the color image on the paper. The copied paper delivery roller 116 sends out the paper on which the color image has been fixed to the copy receiving tray 117.

Subsequently, detailed explanation of the electrostatic charger is made taking the electrostatic charger 32A of the image forming unit 101A as an example. Here, the electrostatic charger 32A of the image forming unit 101A has the same configuration as the electrostatic chargers 32B through 32D of other image forming units 101B through 101D.

Figure 2A:
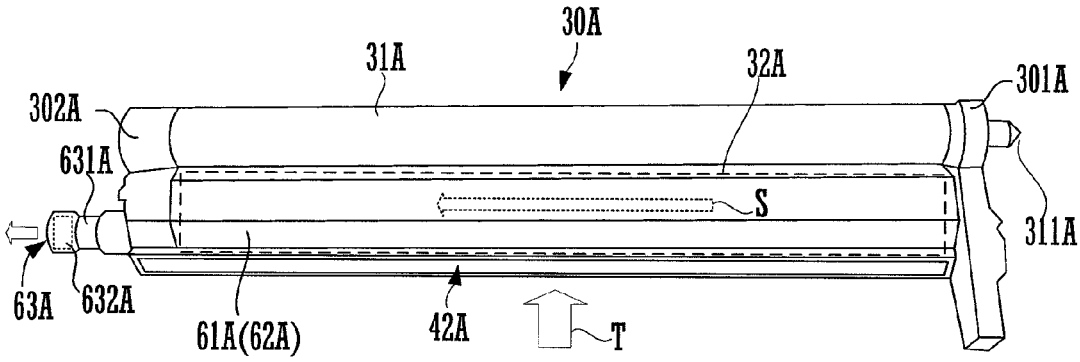
FIG. 2A is a general view of a unit including the electrostatic charger.

As shown in FIG. 2A, the electrostatic charger 32A is installed, as an example, in an integrated unit 30A together with the photoreceptor drum 31A and the cleaning device 36A.

Casings 301A and 302A each installed in either end of the unit 30A hold a rotating shaft 311A of the photoreceptor drum 31A in such a manner as to be freely rotatable. The electrostatic charger 32A is installed, as shown in the dashed line in FIG. 2A, at a position opposed to the photoreceptor drum 31A. The unit 30A is provided with an air-intake opening 42A (second air-intake opening) in a face on a side opposite to the photoreceptor drum 31A in a direction perpendicular to the rotating shaft of the photoreceptor drum 31A. Also, the casing 302A is provided with a tubular exhaust section 631 extending outward in the direction parallel to the rotating shaft of the photoreceptor drum 31A. At an end of the exhaust section 631, an air-exhaust opening 63A is installed. Between the photoreceptor drum 31A and the air-intake opening 42A, a cover 61A for an exhaust duct 62A is detachably mounted on the outside of the unit 30A.

Figure 2B:
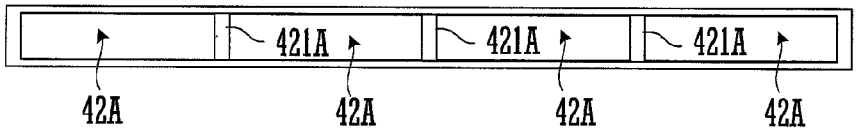
FIG. 2B is a front view of an air-intake opening provided in a unit shown in FIG. 2A.

When viewed from a direction of the arrow T in FIG. 2A (from the bottom side of the unit 30A), the air-intake opening 42A has a shape as shown in FIG. 2B, with a plurality of ribs 421A provided at regular intervals.

To the exhaust section 631A is attached an air current generator (air current generating section) 632A. The air current generator 632A is one that generates an air current flowing from the air-intake opening 42A through the interior of a case for shielding for the electrostatic charger 32A to the air-exhaust opening 63A, and may preferably be a fan, for example. The air current generator 632A may be provided on the side of the air-intake opening 42A.

Figure 2C:
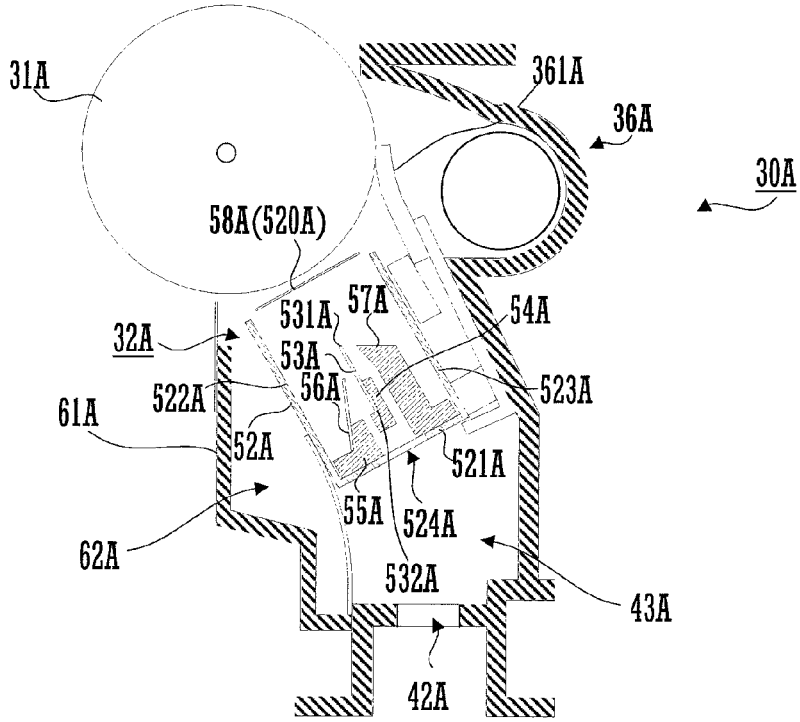
FIG. 2C is a sectional view showing a configurative outline of the electrostatic charger according to the embodiment of the present invention.

As shown in FIG. 2C, the electrostatic charger 32A comprises a case for shielding 52A, a saw-toothed electrode 53A as an example of a discharge electrode, an electrode holder 54A, a guide plate holder 55A, a guide plate 56A, an air barrier 57A and a grid electrode 58A.

The case 52A, formed from a conductive shield plate having a U-shaped cross section, surrounds the periphery of the saw-toothed electrode 53A. The case 52A comprises an opening 520A opposed to a tip portion 531A of the saw-toothed electrode 53A, a bottom face 521A opposed to a bottom edge portion 532A of the saw-toothed electrode 53A, a left side face 522A and a right side face 523A each opposed to either side face of the saw-toothed electrode 53A, front face and rear face not shown. The length of the case 52A in width direction (direction of the rotating shaft of the photoreceptor drum 31A) is almost the same as the whole longitudinal length of the air-intake opening 42A. The electrostatic charger 32A is disposed so as to have the opening 520A opposed to the surface of the photoreceptor drum 31A. At the opening 520A is installed a grid electrode 58A.

In the middle part of the bottom face 521A is provided an air-intake opening 524A (first air-intake opening). The air-intake opening 524A is provided so as to take the air inside from the outside of the case 52A.

In the middle part of the case 52A is installed the electrode holder 54A of a width that is smaller than that of the air-intake opening 524A at a certain space from the air-intake opening 524A. The electrode holder 54A, having a L-shaped cross section, is installed perpendicularly to the bottom face 521A and the grid electrode 58A so that the tip of the saw-toothed electrode 53A is opposed to the grid electrode 58A.

Figure 3A:
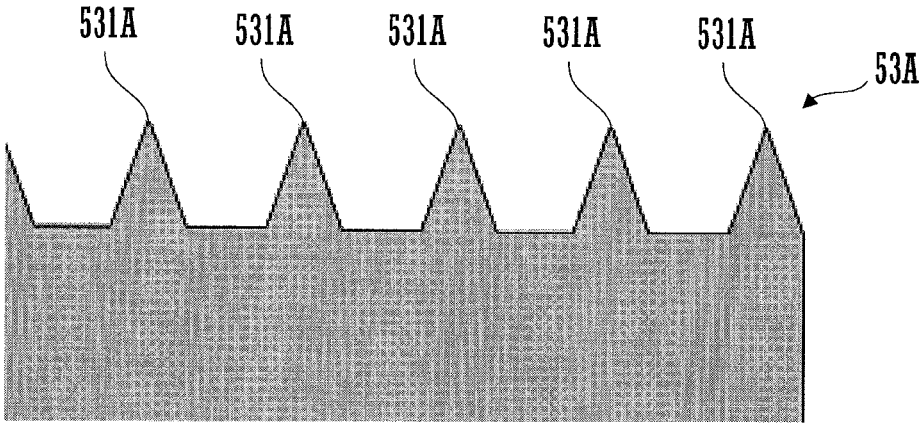
FIG. 3A is a general view of a discharge electrode.

The tip portion 531A of the saw-toothed electrode 53A is installed at a predetermined space from the grid electrode 58A. The saw-toothed electrode 53A is a lamina made of metal (e.g., stainless steel) attached to the electrode holder 54A using an adhesive, screws or the like not shown. The saw-toothed electrode 53A is machined and/or formed in a saw-toothed shape as shown in FIG. 3A, for example, and has a plurality of sharp protrusions (tips for the electrostatic discharge) 531A provided at regular intervals (disposed intermittently).

The guide plate holder 55A, having a L-shaped cross section, is opposed to the electrode holder 54A at a predetermined space so as to permit ventilation, and is in contact with the bottom face 521A. To the guide plate holder 55A is attached the guide plate 56A. The guide plate holder 55A holds the guide plate 56A at a predetermined angle of inclination.

The guide plate 56A corresponds to a guide member of the present invention, and is installed at a predetermined angle of inclination leaving a predetermined space from the saw-toothed electrode 53A so as to permit ventilation. The guide plate 56A directs the air current having flowed in from the air-intake opening 524A to surroundings of the tip portions 531A of the saw-toothed electrode 53A.

The air barrier 57A (guide member), having a L-shaped cross section, is installed in contact with the bottom face 521A of the case 52A with its one side face opposed to the electrode holder 54A and the saw-toothed electrode 53A at a predetermined space so as to permit ventilation. A top surface 571A of the air barrier 57A is inclined at a predetermined angle. The air barrier 57A directs the air current having flowed in from the air-intake opening 524A to the surroundings of the tip portions 531A of the saw-toothed electrode 53A.

The grid electrode 58A is one made of metal such as stainless steel, for example, or the like and formed into a mesh so as to be permeable, and is connected to a power supply not shown. Also, the saw-toothed electrode 53A is connected to a high voltage power supply not shown.

Between the air-intake opening 524A and the air-intake opening 42A is provided a passage 43A (air-intake passage) that conducts the air current taken inside from the outside of the unit 30.

Further, between the cover 61A and the case 52A is provided the exhaust duct 62A.

In the electrostatic charger 32A, the air current taken inside from the air-intake opening 42A passes the passage 43A, and flows into the electrostatic charger 32A from the air-intake opening 524A. The air current having flowed into the electrostatic charger 32A is directed (guided) by the guide plate 56A and the air barrier 57A, passes through the tip portions 531A of the saw-toothed electrode 53A, and then flows out of the opening 520A. The air current having flowed out of the opening 520A flows through the exhaust duct 62A (corresponding to an air-exhaust passage of the present invention) in a direction of the arrow S shown in FIG. 2A, and is then exhausted out of the air-exhaust opening 63A of the exhaust section 631.

With the present invention, as described above, because providing the guide plate 56A and the air barrier 57A opposed to either side of the saw-toothed electrode 53A makes it possible to ensure that the air current passes around the tip portions 531A of the saw-toothed electrode 53A, adhesion of dust such as silica particles and/or toner particles to the tip portions 531A of the saw-toothed electrode 53A is prevented. Detailed description is being given below.

Also, in the present invention, in order to pass the clean air current not containing the dust to the tip portions 531A of the saw-toothed electrode 53A, the air-intake opening 42A is provided in a face on the opposite side of a face opposed to the photoreceptor drum 31A of the unit 30A, as shown in FIG. 2C. Providing the air-intake opening 42A in such a position ensures that the air-intake opening 42A is isolated from the photoreceptor drum 31A, so that the clean air not containing the dust can be taken inside from the air-intake opening 42A. Further, the air-intake opening 42A may be disposed in such a manner as to face the outside of the image forming unit 101. Normally there is no dust such as silica and/or toner floating outside the image forming unit 101A, so that the clean air not containing the dust can be taken inside from the air-intake opening 42A and be delivered through the passage 43A to an electrostatic charger 32A.

It is also possible to employ a configuration in which the air not containing the dust is taken inside from the outside of the image forming apparatus 1 by additionally connecting a duct to the air-intake opening 42A. For example, the configuration may be such that a duct is connected to the air-intake opening 42A so that the air is taken inside from the front face side (near side in FIG. 1) of the image forming apparatus 1 and that the air current flows through the duct to the electrostatic charger 32A.

Additionally, it is preferred that a filter is installed at the air-intake opening 42A to prevent the dust entering into the passage 43A.

In the present invention, the air-exhaust opening 63A that exhausts to outside of the image forming unit 101 is provided so that the air exhausted from the electrostatic charger 32A will not stay in the image forming unit 101.

The air exhausted from the electrostatic charger 32A passes through the exhaust duct 62A, and is then exhausted from the air-exhaust opening 63A.

As shown in FIG. 2A, the air-exhaust opening 63A is provided at a position isolated from the air-intake opening 42A. Also, as described above, in the case where the duct is connected to the air-intake opening 42A so as to take the air inside from the front face side (near side in FIG. 1) of the image forming apparatus 1, the air-exhaust opening 63A is provided in the rear face, which is a face on the opposite side, of the image forming apparatus 1. With this configuration, it is ensured that the air containing the dust such as silica exhausted from the air-exhaust opening is not taken inside from the air-intake opening 42A.

Also, preferably a filter is installed at the air-exhaust opening 63A to prevent the dust being exhausted from the exhaust duct 62A.

Subsequently, a procedure for charging the photoreceptor drum 31A by the electrostatic charger 32A is explained below.

When a negative high voltage of around −5 kV, for example, is applied to the saw-toothed electrode 53A using a high voltage power supply not shown, an electric field that occurs is concentrated at the tips of the saw-toothed electrode 53A, and then a discharge begins out of the tip portions 531A of the saw-toothed electrode 53A. In a region where the discharge takes place, gases such as oxygen ionize, and this results in formation of negatively charged ions (charged particles) and ozone, a form of oxygen generated by dissociation and coupling. Ions formed in the discharge region move along the electric field. Then, when a negative voltage of, for instance, around −650V that is weaker than the voltage applied to the saw-toothed electrode 53A is applied to the grid electrode 58A using a power supply not shown, the ions move from the saw-toothed electrode 53A toward the grid electrode 58A. While part of the ions move toward the grid electrode 58A, the rest of the ions, passing through the grid electrode 58A, reach the photoreceptor drum 31A, thereby causing the surface of the photoreceptor drum 31A to be negatively charged. With the movement of the ions from the neighborhood of the saw-toothed electrode 53A to the direction of the grid electrode 58A in accordance with the electric field, a current of air (ion wind) occurs.

In the electrostatic charger 32A, since the air current generator 632A is installed on either the air-intake opening 42A or the air-exhaust opening 63A as described above, part of the ion wind is exhausted outside the case 52A by the air current flowing from the air-intake opening 42A to the air-exhaust opening 63A. Besides, the ozone generated at the electrostatic charge section 51A can be forcibly exhausted outside the image forming unit 101A.

Nevertheless, in the electrostatic charger 32A, when the discharge is started in a manner as described above, an air current occurs that circulates the interior of the case 52A and the neighborhood of the surface of the photoreceptor drum 31A due to the ion wind; so that there is a risk that the air current may come into contact with the tip portions 531A (saw-toothed portions) of the saw-toothed electrode 53A.

Figure 3B:
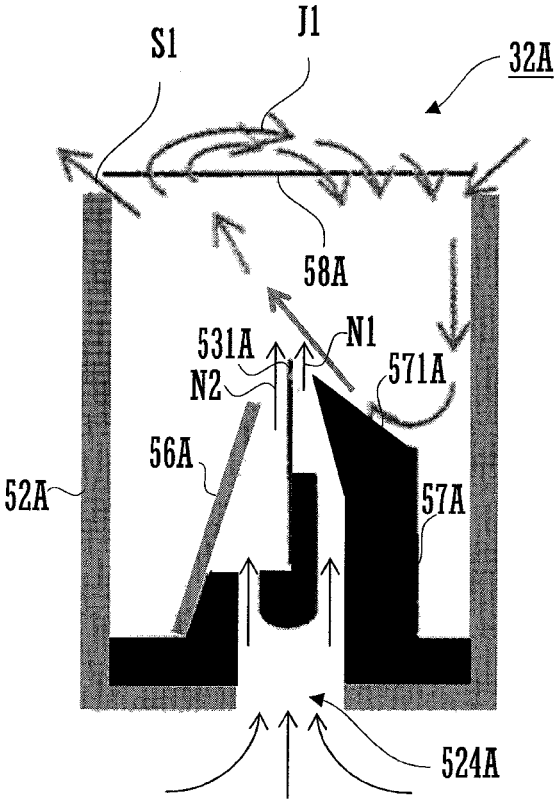
FIG. 3B is an enlarged view of the electrostatic charger.

Thus, in the present invention, an angle of elevation for a top surface of the air barrier 57A is formed, as shown in FIG. 3B, so as not to become less than an angle of elevation for the tip portions 531A of the saw-toothed electrode 53A.

Figure 4:
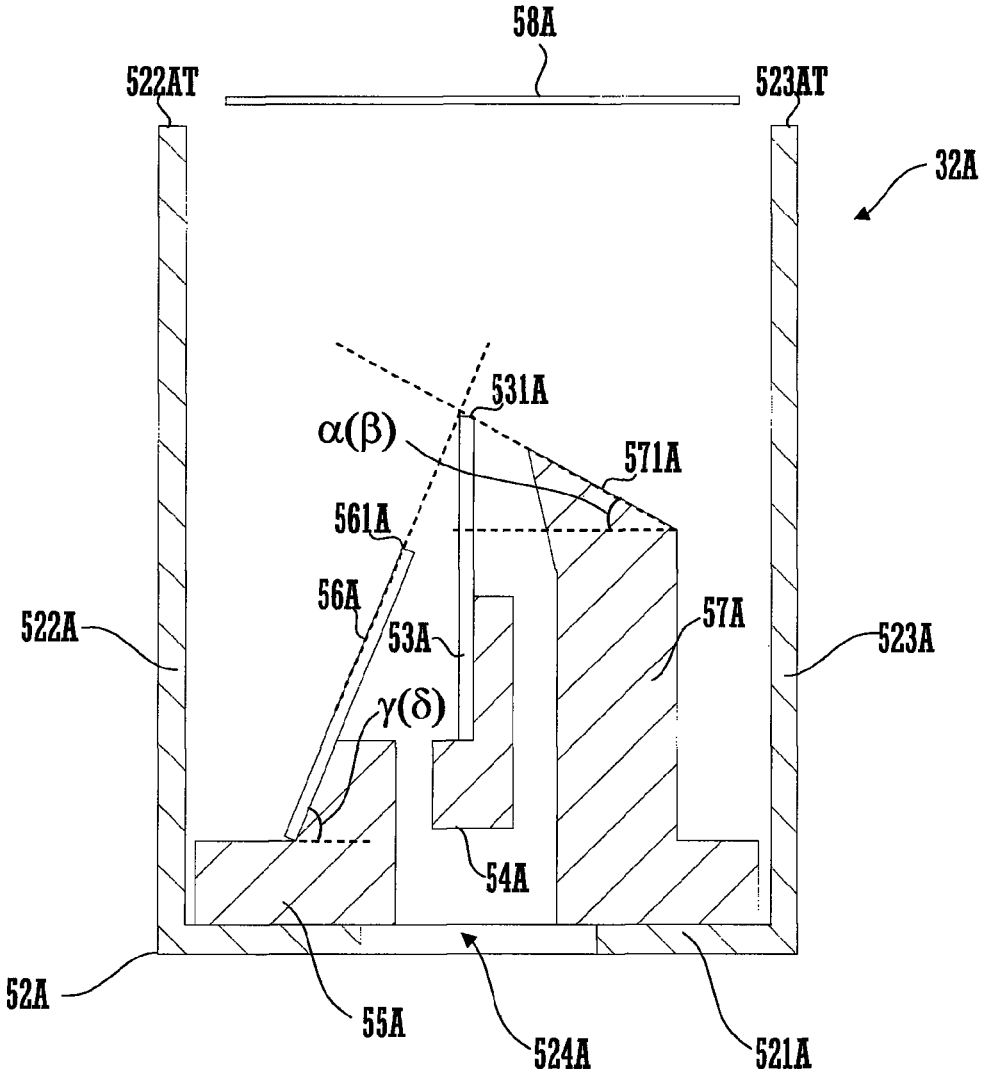
FIG. 4 is a sectional view showing a configuration of the electrostatic charger.

That is, as shown in FIG. 4, the top surface 571A of the air barrier 57A is inclined to the extent that the circulating air current J1 will not come into contact with the tip portions 531A of the saw-toothed electrode 53A. The angle of elevation (angle of inclination) alpha ($\alpha$) for the top surface 571A is set at a value not less than the angle of elevation beta ($\beta$) for the tip portion 531A of the saw-toothed electrode 53A. With this configuration, the circulating air current J1 is caused to flow along the top surface 571A of the air barrier 57A as shown in FIG. 3B, while the air current N1 taken inside the case 52A through the air-intake opening 42A is caused to pass the tip portions 531A of the saw-toothed electrode 53A. Therefore, the circulating air current J1 will not come into contact with the tip portions 531A of the saw-toothed electrode 53A, so that adhesion of the dust to the tip portions 531A can be prevented. Further, with the air current flowing in from the air-intake opening 42A, involution of the circulating air current J1 to the tip portions 531A of the saw-toothed electrode 53A can also be prevented.

Further, the guide plate 56A is inclined in such a manner that the circulating air current J1 will not come into contact with the tip portions 531A of the saw-toothed electrode 53A. An angle of elevation (angle of inclination) gamma ($\gamma$) for the guide plate 56A is set at a value not less than an angle of elevation delta ($\delta$) for the tip portion 531A of the saw-toothed electrode 53A. As shown in FIG. 3B, an air current circulating between the left side face 522A of the case 52A and the guide plate 56A does not occur normally. However, even if such an air current occurs as circulates the neighborhood of the guide plate 56A due to any changes of air current velocity and/or the like, the circulating air current flows along the guide plate 56A; so that the circulating air current can be prevented from coming into contact with the tip portions 531A of the saw-toothed electrode 53A. Moreover, because the air current N2 flowing into the case 52A through the air-intake opening 42A passes around the tip portions 531A of the saw-toothed electrode 53A, the circulating air current can be further prevented from coming into contact with the tip portions 531A of the saw-toothed electrode 53A. Therefore, even when the circulating air current occurs, adhesion of the dust to the tip portions 531A of the saw-toothed electrode 53A can be prevented.

Here, velocities of the air currents N1 and N2 are each set at a value of, preferably, about 1.0 m/s through 3.0 m/s, for examples. This is because of the risk that protection of the tip portions 531A by the air currents N1, N2 may be hindered if the air current velocities are too small, and that electrostatic charge of the photoreceptor drum 31A may be hurt if the air current velocity is too large.

Figure 3C:
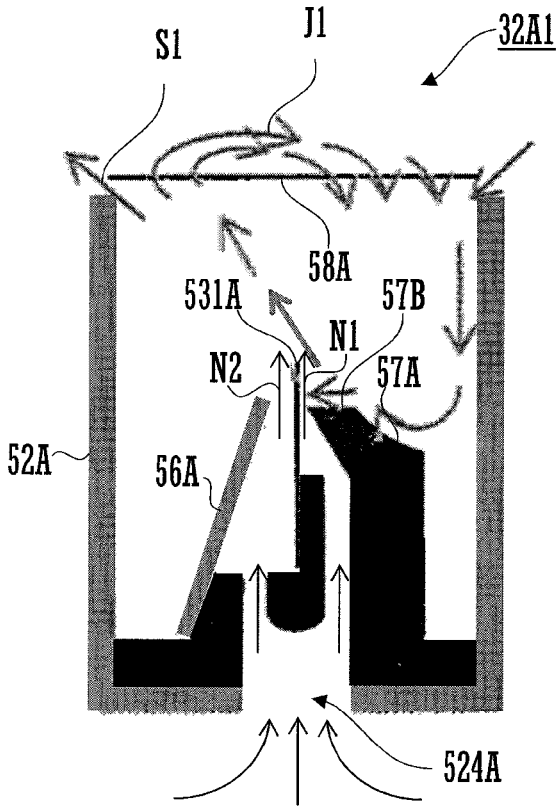
FIG. 3C is an enlarged view of an electrostatic charger according to another embodiment of the present invention.

An electrostatic charger 32A1 shown in FIG. 3C is configured in such a manner that a top surface 57B of the air barrier 57A is perpendicular (zero degree) to the saw-toothed electrode 53A, and that the top surface of the air barrier 74A is positioned at a height lower than the tip portions 531A of the saw-toothed electrode 53A. When the discharge is started and ion wind occurs in the electrostatic charger 32A1 having such a configuration, part of the ion wind J1, passing through the grid electrode 58A, then flowing toward the right direction along the surface of the photoreceptor drum 31A and a blade 361A, and then flowing into the case 52A, flows along the right side face 523A and the top surface of the air barrier 57A. In other words, the ion wind J1 results in a circulating air current J1. As shown in FIG. 3C, the circulating air current J1 passes the neighborhood of the tip portions 531A (saw-toothed portions) of the saw-toothed electrode 53A after passing the top surface of the air barrier 57A. In this case, increasing the strength of the air current flowing in from the air-intake opening 524A as compared with that employed in the configuration shown in FIG. 3B makes it possible for the tip portions of the saw-toothed electrode 53A to be encompassed in the air currents N1, N2 flowing in from the air-intake opening 524A. Therefore, the tip portions of the saw-toothed electrode 53A can be protected against contact with the circulating air current J1, thereby preventing the adhesion of dust to the tip portions 531A of the saw-toothed electrode 53A.

Subsequently, another embodiment of the electrostatic charger 32A.

Figure 5A:
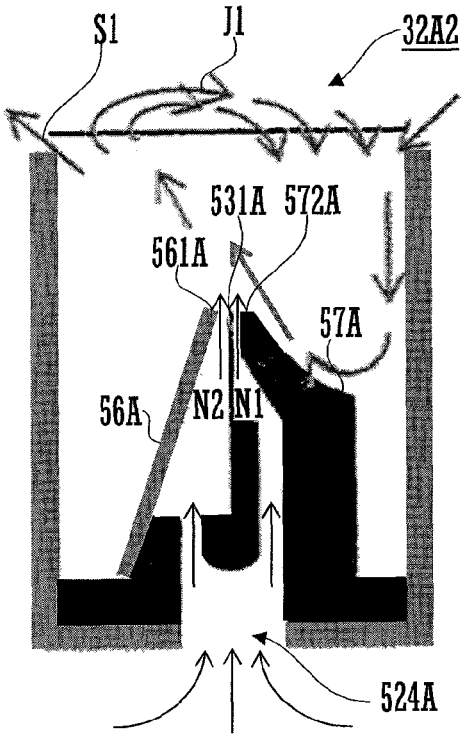
FIG. 5A is a view showing a configuration in which a guide plate and an air barrier are disposed opposed to each other at a tip portion of the discharge electrode.

An electrostatic charge section 32A2 shown in FIG. 5A is configured in such a manner that a top edge 561A of the guide plate 56A and a top surface 572A of the air barrier 57A are positioned at the same height as the tip portions 531A of the saw-toothed electrode 53A. Or, the top edge of the guide plate 56A and the top surface of the air barrier 57A may be positioned higher than the tip portions 531A of the saw-toothed electrode 53A. Disposing the guide plate 56A and the air barrier 57A opposed to each other at the tip portions 531A of the saw-toothed electrode 53A in this manner makes it possible not only for the tip portions of the saw-toothed electrode 53A to be encompassed by the air currents N1, N2 flowing in from the air-intake opening 524A, but also for the guide plate 56A and the air barrier 57A to function as protective plates against the circulating air current J1. Therefore, the tip portions of the saw-toothed electrode 53A can securely be protected against contact with the circulating air current J1, thereby preventing the adhesion of dust to the tip portions 531A of the saw-toothed electrode 53A.

Figure 5B:
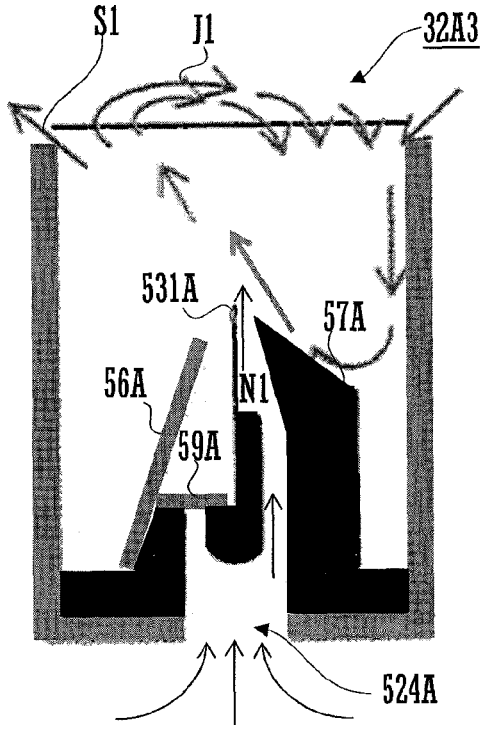
FIG. 5B is a view showing a configuration in which a plate is mounted astride on both a surface of an electrode holder in contact with a bottom portion of the discharge electrode and a top surface of the guide plate holder.

Secondly, an electrostatic charge section 32A3 shown in FIG. 5B is configured in such a manner that a plate 59A is mounted astride on both a surface of the electrode holder 54A in contact with a bottom portion of the saw-toothed electrode 53A and a top surface of guide plate holder 55A so that the air will not pass between the guide plate holder 55A and the electrode holder 54A. In this manner, even the configuration that allows for only the air current N1 passing one side of the tips of the saw-toothed electrode 53A makes it possible to prevent the adherence of dust to the tip portions 531A of the saw-toothed electrode 53A.

In addition, the air current can be diverted to a desired direction by adjusting the height of the guide plate 56A.

Figure 5C:
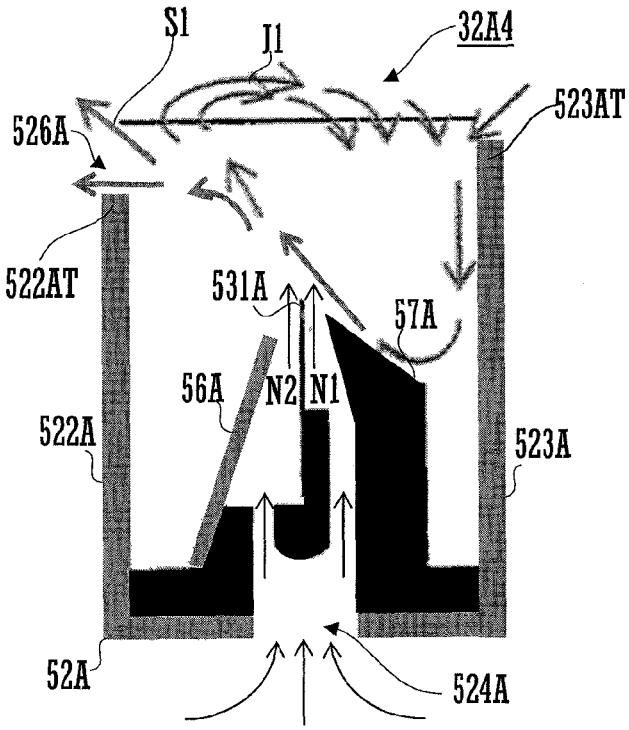
FIG. 5C is a view showing a configuration in which an air-exhaust opening is provided between a left side face of a case and a grid electrode.

Next, an electrostatic charge section 32A4 shown in FIG. 5C is configured in such a manner that an edge portion 522AT of the left side face 522A of the case 52A is made lower in position than an edge portion 523AT of the right side face 523A, and that an air-exhaust opening 526A is provided between the left side face 522A and the grid electrode 58A. Such a configuration allows an air current S1 having passed the tip portions 531A of the saw-toothed electrode 53A to advance toward a direction of left upper portion of the case 52A, making it possible to exhaust the air current S1 smoothly.

Figure 6A:
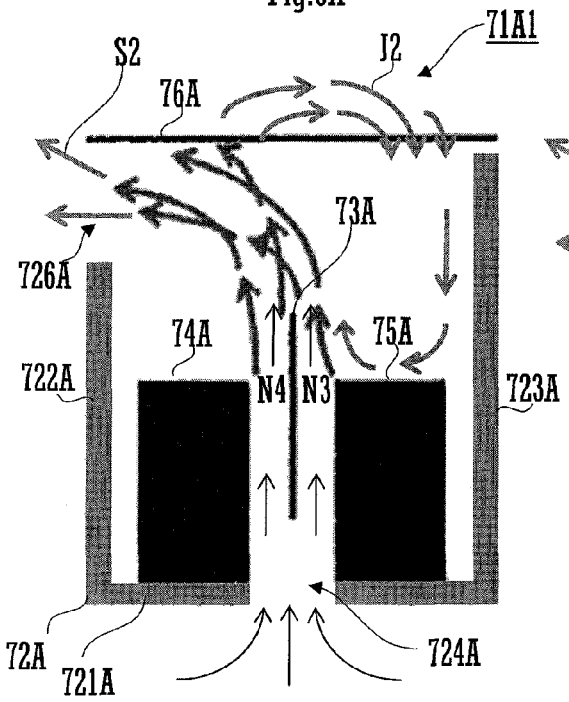
FIG. 6A is a view showing a state of an air current when air barriers having the same height one another are installed leaving the same space in between as the width of the opening.

Subsequently, still another embodiment of the electrostatic charger is explained. As shown in FIG. 6A, an electrostatic charge section 71A1 comprises a case 72A, a saw-toothed electrode 73A, an air barrier 74A, an air barrier 75A and a grid electrode 76A.

The case 72A has a U-shaped cross section, and includes a bottom face 721A, a left side face 722A and a right side face 723A. The left side face 722A is made lower (shorter) in height than the right side face 723A. In the middle part of the bottom face 721A is formed an opening 724A. The opening 724A is provided so as to take the air inside from the outside of the case 72A. At the case 72A is installed a grid electrode 76A. The left side face 722A is made lower than the right side face 723A as described above, and an opening (air-exhaust opening) 726A is formed between the edge portion 722AT of the left side face 722A and the edge portion 76AT1 of the grid electrode 76A.

In the electrostatic charge section 71A1, the saw-toothed electrode 73A is supported by a front face and a rear face of the case 72A without an electrode holder provided.

The air barrier 74A and the air barrier 75A each have a rectangular cross section, and their bottom portions are in contact with the bottom face 721A of the case 72A. The air barriers 74A and 75A are installed at a certain space from the saw-toothed electrode 73A (with the same width as the opening 724A). Here, the air barriers 74A and 75A have the same height, and the saw-toothed electrode 73A is positioned higher than the air barriers 74A and 75A. In other words, tips of the saw-toothed electrode 73A are held in a state of sticking out from a space between the air barriers 74A and 75A.

Such a configuration allows the air (air current) taken inside from the opening 724A to pass both sides of the saw-toothed electrode 73A, and then to be exhausted from the opening (air-exhaust opening) 726A. Therefore, in the same manner as the charge section 51A, adhesion of the dust to the tips of the saw-toothed electrode 73A can be prevented by causing the air currents N3, N4 to encompass the tips of the saw-toothed electrode 73A. Moreover, the opening 726A thus provided makes it easier for the air (air currents N3, N4) taken inside from the opening 724A to be exhausted smoothly from the interior of the case 71A to outside.

Figure 6B:
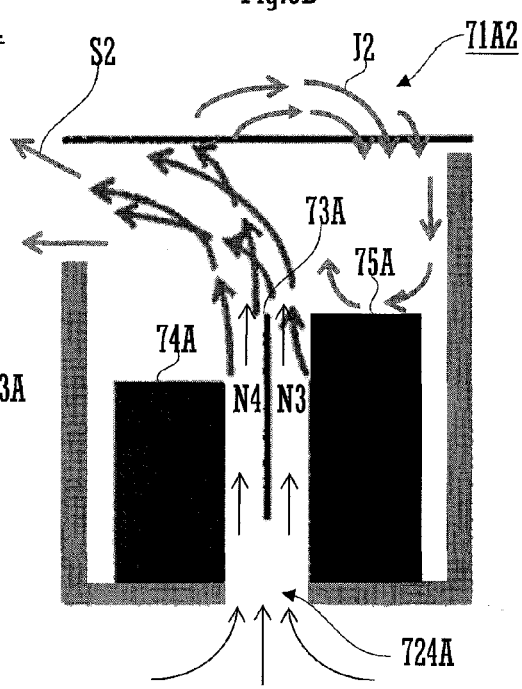
FIG. 6B is a view showing a state of the air current when air barriers having heights different from one another are installed leaving the same space in between as the width of the opening.

An electrostatic charge section 71A2 shown in FIG. 6B includes a modification made to the air barrier 75A in the electrostatic charge section 71A1 so as to have the same height as the saw-toothed electrode 73A. With such a configuration, even when a circulating air current J2 occurs in the electrostatic charge section 71A2, the circulating air current J2 will not come into contact with the tip portions of the saw-toothed electrode 73A, so that adhesion of the dust to the tip portions can be prevented securely.

Figure 6C:
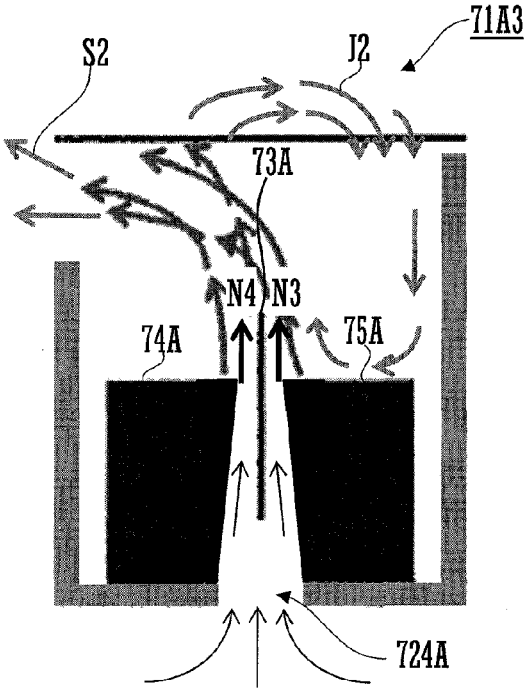
FIG. 6C is a view showing a state of the air current when the space between the air barriers is narrowed gradually along the height thereof.

An electrostatic charge section 71A3 shown in FIG. 6C includes a modification made to the air barrier 74A and the air barrier 75A in the electrostatic charge section 71A1 so as to each have a trapezoidal cross section, and to have thereby gradually narrowed passages (between the saw-toothed electrode 73A and the air barriers 74A, 75A) for the air currents N3, N4 flowing from the opening 724A to the tip portions of the saw-toothed electrode 73A. Such a configuration allows the air currents N3, N4 to pass either side of the tip portions 731A at a higher velocity, thereby preventing more securely the adhesion of dust to the tip portions 731A.

In addition, although a saw-toothed electrode is explained above as an example of the discharge electrode, the present invention is not limited to such; the discharge electrode may be in any other shape so long as tips for the electrostatic discharge are disposed intermittently.

REFERENCE SIGNS LIST

1 image forming apparatus
30A unit
31A-31D photoreceptor drum
32A-32D electrostatic charger
42A air-intake opening
43A air current through a passage
52A case
53A saw-toothed electrode
54A electrode holder
55A guide plate holder
56A guide plate
57A air barrier
58A grid electrode
59A plate
61A cover
62A exhaust duct
63A air-exhaust opening
632A air current generator
101A-101D image forming unit

The invention claimed is:

1. An electrostatic charger for charging a photoreceptor by performing a discharge to the photoreceptor, the charger comprising:

a discharge electrode having a saw-toothed tip portion;

a case for shielding disposed surrounding the discharge electrode leaving a space in between, the case provided with an opening at which a grid electrode is installed opposed to the tip portion of the discharge electrode, and a bottom face in which a first air-intake opening is provided opposed to an edge portion on the opposite side of the tip portion of the discharge electrode;

an air current generating section generating an air current that flows in from the first air-intake opening and passes through the interior of the case;

a guide member that is installed in the case and directs the air current generated by the air current generating section from the first air-intake opening to the tip portion of the discharge electrode in the case and thus forms a passage of the air current passing around the tip portion, the guide member being opposed to the discharge electrode and forming a top surface inclined toward the discharge electrode;

an air-intake passage directing the air current from a second air-intake opening that is isolated from the photoreceptor to the first air-intake opening; and an air-exhaust passage directing the air current exhausted from the opening of the case after passing around the tip portion of the discharge electrode to an air-exhaust opening that is isolated from the second air-intake opening.

2. The electrostatic charger as claimed in claim 1 wherein the guide member has the top surface inclined at an angle not less than an angle of elevation for the tip portion of the discharge electrode.

3. The electrostatic charger as claimed in claim 1 wherein a passage formed by the guide member is narrower than the first air-intake opening.

4. An image forming apparatus comprising the electrostatic charger as claimed in claim 1 and an image forming section, wherein the image forming section forms a toner image on a photoreceptor charged by the electrostatic charger and transfers the toner image onto paper.

* * * * *